US007221889B2

(12) United States Patent
Patton et al.

(10) Patent No.: US 7,221,889 B2
(45) Date of Patent: May 22, 2007

(54) REPLACEABLE DEVELOPER ROLLER

(75) Inventors: M. Derek Patton, San Diego, CA (US); Ziv Gilan, San Diego, CA (US); Christopher S. Tanner, La Mesa, CA (US); Marco Guzman, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 11/077,438

(22) Filed: Mar. 10, 2005

(65) Prior Publication Data

US 2006/0204275 A1 Sep. 14, 2006

(51) Int. Cl.
*G03G 15/04* (2006.01)
*G03G 15/08* (2006.01)

(52) U.S. Cl. ..... 399/119; 399/286

(58) Field of Classification Search ..... 399/110, 399/111, 119, 222, 239, 279, 286
See application file for complete search history.

(56) References Cited

U.S. PATENT DOCUMENTS

| | | | | |
|---|---|---|---|---|
| 385,026 | A | 6/1888 | Waldron | |
| 4,830,165 | A | 5/1989 | Guslits et al. | |
| 4,839,690 | A | 6/1989 | Onoda et al. | |
| 5,151,737 | A | 9/1992 | Johnson et al. | |
| 5,682,587 | A | 10/1997 | Higeta et al. | |
| 5,774,766 | A * | 6/1998 | Karakama et al. | 399/111 |
| 5,983,055 | A | 11/1999 | Bito et al. | |
| 6,019,038 | A | 2/2000 | Kusunoki et al. | |
| 6,104,898 | A * | 8/2000 | Awano et al. | 399/119 |
| 6,154,627 | A * | 11/2000 | Iwamatsu et al. | 399/286 |
| 6,347,204 | B1 | 2/2002 | Kurosawa | |
| 6,473,578 | B2 * | 10/2002 | Miyabe et al. | 399/119 |
| 6,615,722 | B2 | 9/2003 | Alberstadt et al. | |
| 6,671,475 | B2 * | 12/2003 | Katada et al. | 399/111 |
| 6,952,543 | B2 * | 10/2005 | Kusudo | 399/111 X |

FOREIGN PATENT DOCUMENTS

| | | |
|---|---|---|
| EP | 0691589 A2 | 1/1996 |
| JP | 2000132054 | 5/2000 |
| JP | 2000242075 | 9/2000 |

OTHER PUBLICATIONS

International Search Report for Application No. PCT/US2006/008713. Report issued Jul. 18, 2006.

* cited by examiner

*Primary Examiner*—Sandra L. Brase

(57) ABSTRACT

A replaceable developer roller apparatus is disclosed for a printing device. The apparatus includes a cylindrical developer roller having two opposed ends, and a drive assembly selectively and operatively engageable with one of the opposed ends of the developer roller. The drive assembly includes a shaft having two opposed regions; a gear rotationally fixed to one of the opposed regions of the shaft; and a drive member rotationally fixed to the other of the opposed regions of the shaft, and selectively, axially moveable between an engagement position and a disengagement position. A spindle assembly is engageable with the other of the opposed ends of the developer roller. The spindle assembly includes a spindle assembly shaft and an alignment member rotationally fixed to the spindle assembly shaft.

35 Claims, 3 Drawing Sheets

REPLACEABLE DEVELOPER ROLLER

BACKGROUND

The present disclosure relates generally to developer rollers and more particularly to replaceable developer rollers.

A binary ink developer (BID) is a consumable that is often used in a printing device. This consumable is generally made from custom and/or off-the-shelf parts. Failure of a component(s) in this consumable may, in some instances, induce an operator to replace the entire BID. This is due, at least in part, to the relative difficulty of replacing the components within the BID.

One component of the BID is the developer roller. Current developer rollers include a solid aluminum shaft with a urethane layer molded thereon. Generally, the life span of a developer roller may be variable. Potential failures associated with the developer roller may, in some instances, affect the print quality of the BID. As such, operators may be inclined to replace the developer roller itself, however, this is generally not an easy task. The replacement of the developer roller in current binary ink developers includes the potential risk of damaging another component during replacement. Further, as many components generally need to be removed in order to get the developer roller out of the BID, the process would generally be time consuming. Still further, special tools and/or training would likely be used in the process, as there are generally several fasteners that are assembled to a specific torque.

As such, it would be desirable to provide a developer roller that is relatively easily removable from a binary ink developer.

BRIEF DESCRIPTION OF THE DRAWINGS

Objects, features and advantages will become apparent by reference to the following detailed description and drawings, in which like reference numerals correspond to similar, though not necessarily identical components. For the sake of brevity, reference numerals having a previously described function may not necessarily be described in connection with subsequent drawings in which they appear.

DETAILED DESCRIPTION

Liquid electro photography (LEP) printers generally operate in a manner similar to dry electro photography printers, or laser printers. Like a laser printer, a photoconductive drum is charged and is then selectively exposed to a laser to form a charge pattern that corresponds to an image. In LEP printers, the drum is then contacted with a binary ink developer (BID) that selectively transfers a liquid ink pattern to the charge pattern. The liquid ink pattern is transferred from the photoconductive drum to a medium to form the image on the medium.

Figure 1:
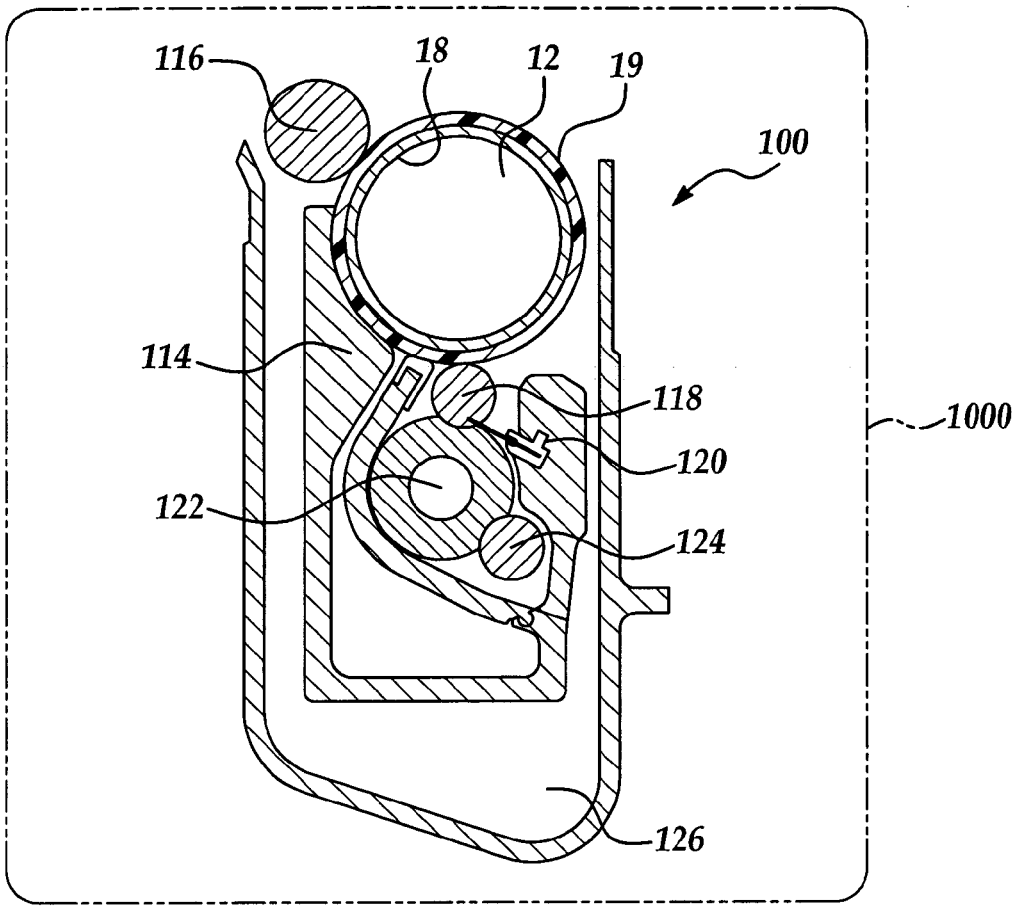
FIG. 1 is a cross sectional semi-schematic view of an embodiment of a binary ink developer.

Referring now to FIG. 1, an embodiment of a printing device 1000 (shown in phantom) having a BID 100 therein is depicted. Generally, the BID 100 includes a developer roller 12, a main electrode 114, a squeegee roller 116, a cleaning roller 118, a wiper 120, a sponge roller 122, a squeezer roller 124, and an ink tray 126.

A potential bias between the main electrode 114 and the developer roller 12 initially transfers charge to the developer roller 12. The squeegee roller 116 regulates the ink film thickness on the developer roller 12. Ink is then selectively transferred from the developer roller 12 to charged portions of the photoconductive drum surface (not shown). The cleaning roller 118 substantially removes remaining ink from the developer roller 12, the wiper 120 cleans the cleaning roller 118, and the sponge roller 122 cleans the wiper 120. This cleaning process, in many instances, may substantially minimize sludge buildup.

The embodiment of the BID 100 shown in FIG. 1 may, in some instances, have a relatively limited life, due, at least in part, to wear of its internal parts over time, the relatively limited life of its developer roller 12, and potential sludge buildup inside the BID 100.

Embodiment(s) of the present disclosure provide a replaceable developer roller apparatus that is suitable for use in a BID 100 (such as that shown in FIG. 1) in a printing device 1000. Without being bound to any theory, it is believed that embodiment(s) of the replaceable developer roller may advantageously extend the life of a BID 100 in which it is used. Upon failure or dissatisfaction with the replaceable developer roller 12, rather than replacing the entire BID 100, the roller 12 itself may be replaced.

Figure 2:
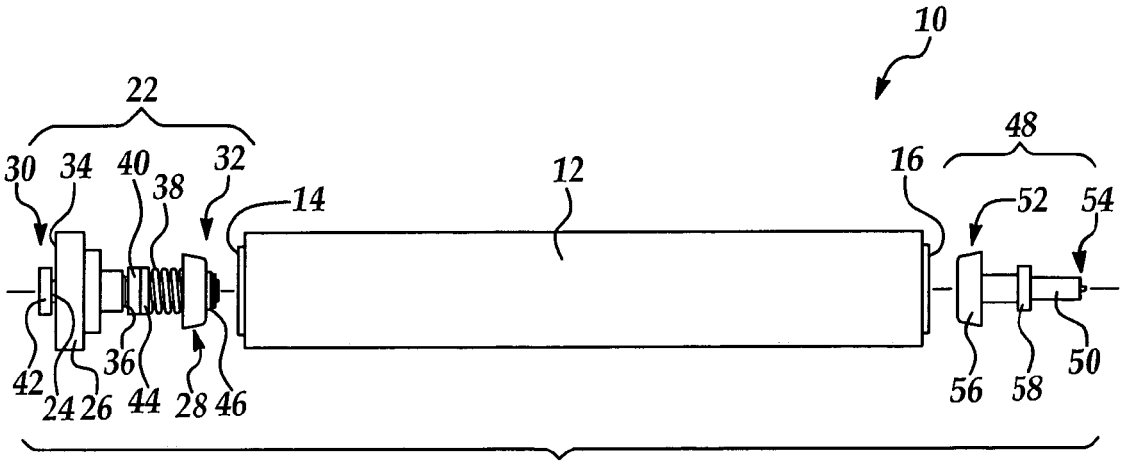
FIG. 2 is an exploded side view of an embodiment of a replaceable developer roller apparatus.
Figure 3:
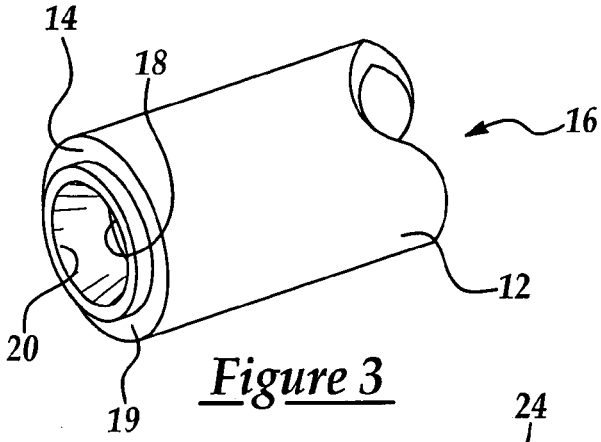
FIG. 3 is a cutaway perspective view of an embodiment of a hollow cylindrical developer roller.

Referring now to FIG. 2, an exploded side view of an embodiment of the replaceable developer roller apparatus 10 is depicted. The replaceable developer roller apparatus 10 includes a hollow cylindrical developer roller 12 having two opposed ends 14, 16. The perspective view of the hollow cylindrical developer roller 12, as shown in FIG. 3, illustrates its hollow, conductive material core 18. It is to be understood that the core 18 may be made of any conductive material, examples of which include metal(s), plastic with conductive layer(s)/materials thereon and/or therein, and the like. In an embodiment, the core 18 is formed from one or more of aluminum, stainless steel, cold drawn steels with a coating thereon, and/or the like, and/or combinations thereof.

The core 18 may also be covered with a layer 19 of a conductive polymeric material, an example of which are polymeric materials incorporating additives such as metal particles, ionic charged particles, carbon black, graphite, and/or the like, and/or combinations thereof. In an embodiment, layer 19 is formed from a conductive urethane material. In the embodiment depicted in FIG. 3, the core 18 has an inner tapered wall section 20 located at each of the opposed ends 14, 16. Opposed end 16 is generally referred to, but not shown in FIG. 3, however, opposed end 16 can be a mirror image of opposed end 14. In an example, each of the inner tapered wall sections 20 has a taper angle ranging from about 3 degrees to about 7 degrees. In a further embodiment, the taper angle is about 5 degrees.

Referring back to FIG. 2, the replaceable developer roller 10 includes a drive assembly 22 selectively and operatively engageable with one of the opposed ends 14, 16 of the developer roller 12. Generally, the drive assembly 22 includes a shaft 24, a gear 26, and a frusto-conical drive member 28.

The shaft 24 of the drive assembly 22 has two opposed regions 30, 32. The gear 26, which has two opposed faces 34, 36, is rotationally fixed to one of the opposed regions 30, 32 of the shaft 24. It is to be understood that the gear 26 may be a spur gear, a helical gear, a worm gear, or the like. In an example, a helical gear is used as it may advantageously substantially reduce the noise produced by the roller 12 when in use.

The frusto-conical drive member 28 is rotationally fixed to the other of the opposed regions 32, 30 of the shaft 24. It is to be understood that the frusto-conical drive member 28 is selectively, axially moveable between an engagement position and a disengagement position (the disengagement position is shown in FIG. 2). Specifically, in the embodiment depicted in FIG. 2, the frusto-conical drive member 28 is axially translatable on the drive shaft 24 between the engagement position and the disengagement position. The frusto-conical drive member 28 may be made such that its shape is complementary with the inner tapered wall section 20 of one of the opposed ends 14, 16 of the developer roller 12. When moved into the engagement position, the drive member 28 frictionally engages the tapered wall section 20 of opposed end 14 or 16.

A spring 38 is disposed on the shaft 24 between one of the opposed faces 34, 36 of the gear 26 and the drive member 28. Any suitable spring 38 may be used, and in an embodiment, the spring 38 is a compression spring, a helical spring, or the like. It is to be understood that the spring 38 advantageously biases the drive member 28 toward the engagement position.

First and second bearings 40, 42 are disposed on the drive assembly shaft 24. One of the first and second bearings 40, 42 is disposed between the spring 38 and one of the opposed faces 36, 34 of the gear 26; while the other of the second and first bearings 42, 40 is disposed adjacent the other of the opposed faces 34, 36 of the gear 26. The bearings 40, 42 may be roller bearings, sleeve bearings, journal bearings, needle bearings, ball bearings, or the like, and/or combinations thereof. For illustrative purposes, the first bearing 40 is shown between the spring 38 and the opposed face 36, and the second bearing 42 is shown adjacent the other of the opposed faces 34.

In an embodiment, a washer 44 may optionally be disposed between the spring 38 and the first bearing 40. It is to be understood that the washer 44 has a high wear surface such that it may withstand, over time and use, pressure exerted when the apparatus 10 is in use and during replacement of developer roller 12. In an embodiment where the washer 44 is not desired, it is to be understood that the spring 38 and first bearing 40 may optionally be designed with high wear surfaces to withstand such pressure as desired. Examples of suitable washers 44 include spacer washers, nylon washers, other polymeric washers (examples of which include polypropylene and high density polyethylene), and the like, and/or combinations thereof.

The drive assembly 22 also includes one or more drive member retaining clips 46 matingly engaged within an annular notch (not shown) that is defined in the other of the opposed regions 32, 30 of the shaft 24. Generally, the annular notch is defined in the shaft 24 at the region 32 opposed to the region 30 where the gear 26 is rotationally fixed. It is to be understood that the clip(s) 46 is located in a position such that the frusto-conical drive member 28 is substantially prevented from axially disengaging from the shaft 24. Examples of suitable clip(s) 46 include, but are not limited to, snap rings, C-clips, E-clips, and the like, and/or combinations thereof. In an embodiment, E-clip(s) are used.

The replaceable developer roller apparatus 10 also includes a spindle assembly 48 that is engageable with the other of the opposed ends 16, 14 of the developer roller 12. The spindle assembly 48 has a shaft 50 with two opposed regions 52, 54. A frusto-conical alignment member 56 is rotationally fixed to the spindle assembly shaft 50 at one of the opposed regions 52, 54. In an embodiment, the frusto-conical alignment member 56 may be made such that its shape is complementary with the inner tapered wall section 20 of the other of the opposed ends 16, 14 of the developer roller 12. It is to be understood that the frusto-conical alignment member 56 frictionally engages the respective inner tapered wall section 20 when the drive member 28 is in the engagement position.

The spindle assembly 48 may also include a bearing 58 on the shaft 50 between the alignment member 56 and the other of the opposed regions 54, 52. It is to be understood that the bearing 58 may be any of the bearings described hereinabove.

Figure 4:
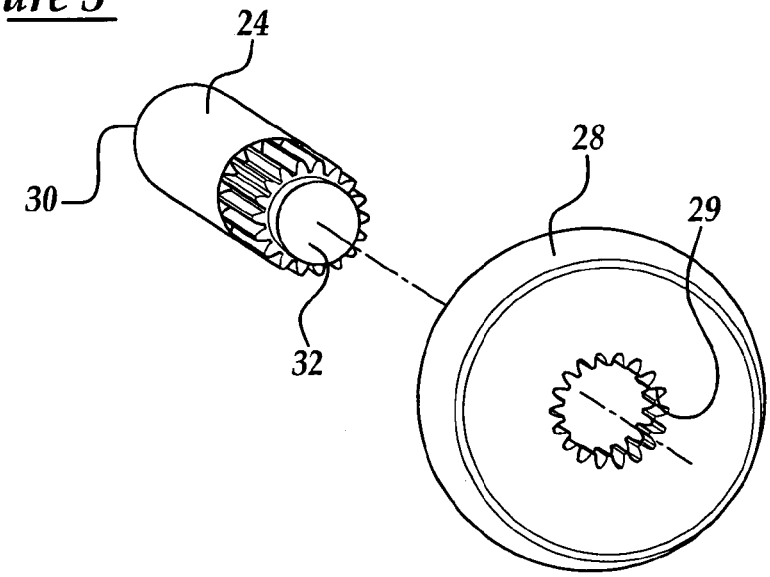
FIG. 4 is an exploded perspective view of an embodiment of a splined drive assembly shaft and a complementarily splined frusto-conical drive member.

Referring now to FIG. 4, an embodiment of the drive assembly shaft 24 is depicted with an embodiment of the frusto-conical drive member 28. It is to be understood that in this embodiment, the frusto-conical drive member 28 is axially translatable on the drive shaft 24. As depicted, the drive assembly shaft 24 is splined at opposed region 32. A center bore 29 of the drive member 28 is splined complementarily to the splined drive assembly shaft 24. It is to be further understood that the splined shaft 24 drivingly engages with the drive member 28.

Figure 5:
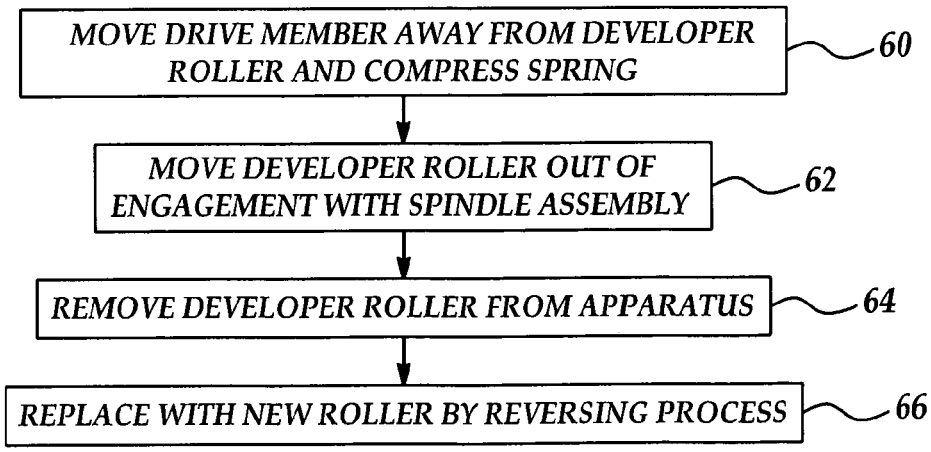
FIG. 5 is a flow diagram depicting an embodiment of the method of replacing an embodiment of a developer roller.

Referring now to FIG. 5, an embodiment of the method of replacing the embodiment of the developer roller 12 shown in FIG. 2 in a printing device 1000 is depicted. The method generally includes moving the drive member 28 away from the developer roller 12 and compressing the spring 38, as shown at reference numeral 60; moving the developer roller 12 out of engagement with the spindle assembly 48, as shown at reference numeral 62; removing the developer roller 12 from apparatus 10, as shown at reference numeral 64; and replacing the removed developer roller 12 with a new developer roller 12 by reversing the process, as shown at reference numeral 66.

More specifically, the method may include axially moving the frusto-conical drive member 28 from its engagement with one of the opposed ends 14, 16 (end 14 as shown in FIG. 2) of the developer roller 12, such that it is disengaged therefrom. In this embodiment of the method, the drive member 28 moves axially independently of the drive shaft 24. Further, the movement of the drive member 28 to the disengagement position may be accomplished by urging (which may be accomplished manually and/or via a common hand tool with a substantially flat head, such as, for example, a flat head screwdriver and/or the like) the drive member 28 out of the opposed end 14, 16 and toward the gear 26. It is to be understood that when the drive member 28 is in the disengagement position, the spring 38 is compressed towards the gear 26.

When the drive member 28 is in the disengagement position, the other of the opposed ends 16, 14 (end 16 as shown in FIG. 2) of the developer roller 12 may be removed such that it is no longer engaging the frusto-conical alignment member 56. The developer roller 12 may then be removed from the printing device 1000.

In an alternate embodiment of the method, the developer roller 12 may be urged toward and with the drive member 28 such that the spring 38 is compressed, and the opposed end 16, 14 disengages from the alignment member 56. Once the developer roller 12 is disengaged from the alignment member 56, the other of the opposed ends 14, 16 may be removed such that it is no longer engaging the frusto-conical drive member 28 of the drive assembly 22. The developer roller 12 may then be removed from the printing device 1000.

Once the developer roller 12 is removed from the printing device 1000 using either of the above methods, one of the opposed ends 16, 14 of a new developer roller 12 may be engaged with the frusto-conical alignment member 56. The frusto-conical drive member 28 may then be moved axially from the disengagement position such that the other of the opposed ends 14, 16 of the new developer roller 12 is engaged therewith. Axially moving the drive member 28 to the engagement position may be accomplished by allowing the spring 38 to urge the drive member 28 into the respective opposed end 14, 16 of the new developer roller 12.

Alternately, once the developer roller 12 is removed from the printing device 1000 using either of the methods described further above, one of the opposed ends 14, 16 of a new developer roller 12 may be engaged with the frusto-conical drive member 28 while compressing spring 38. The frusto-conical alignment member 56 may then be engaged with the other of the opposed ends 16, 14 of the new developer roller 12 by allowing the spring 38 to urge the drive member 28 and engaged roller end 14, 16 toward the spindle assembly 48.

Figure 6:
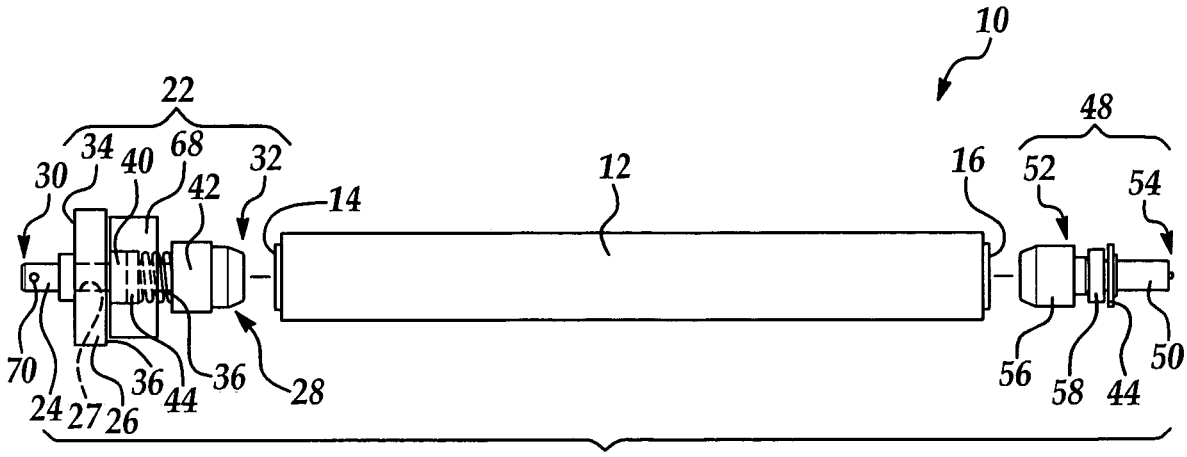
FIG. 6 is an exploded side view of an alternate embodiment of a replaceable developer roller apparatus.

Referring now to FIG. 6, an alternate embodiment of the replaceable developer roller 10 is depicted. In this embodiment, the frusto-conical drive member 28 is both rotationally and axially fixed to the drive shaft 24 at an end 32, 30 opposed to the end 30, 32 where the gear 26 is rotationally fixed. The drive shaft 24 is axially translatable between the engagement position and the disengagement position (the disengagement position is shown in FIG. 6).

In an example, the gear 26 is rotationally fixed to shaft 24 via a notch (not shown) in gear 26 and a pin (not shown) extending through the notch and into shaft 24. In a further example, one of the opposed regions 30, 32 of the drive assembly shaft 24 is splined. A center bore 27 of the gear 26 is also splined such that it is complementary with the splined shaft 24. It is to be understood that the splined shaft 24 drivingly engages with the gear 26.

The drive assembly 22 includes a bearing housing 68 having the first bearing 40 therein. The bearing housing 68 is located along the shaft 24 between one of the opposed faces 36, 34 of the gear 26 and drive member 28. The bearing housing 68 may recess the optional washer 44 therein and may also recess at least a portion of the spring 38 therein.

In this embodiment, the second bearing 42 is disposed on the shaft 24 between the spring 38 and the drive member 28. In an example, the first bearing 40 is a roller bearing, a journal bearing, a needle bearing, or the like; and the second bearing 42 is a needle bearing, a journal bearing, or the like.

A selectively engageable locking mechanism 70 selectively, axially locks the drive assembly shaft 24 in the disengagement position. Examples of suitable locking mechanisms 70 include pin/aperture mechanisms, cams, threaded members, locking levers, and/or the like.

As shown in FIG. 6, the spindle assembly 48 may optionally include a washer 44 disposed on the spindle assembly shaft 50 between the bearing 58 and the opposed region 54. While the washer 44 is not depicted in the spindle assembly 48 of FIG. 2, it is to be understood that the washer 44 may be used in any of the embodiments of the spindle assembly 48 disclosed herein.

Figure 7:
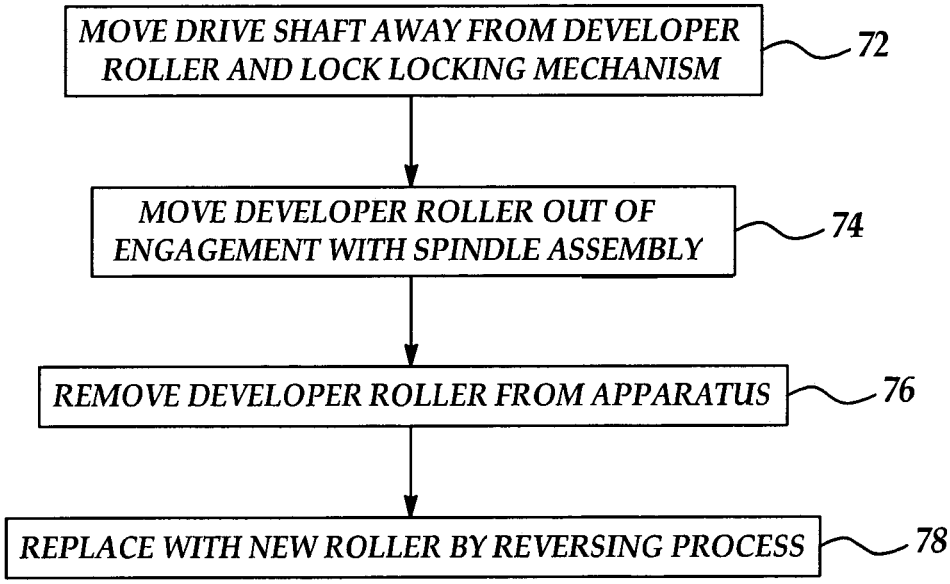
FIG. 7 is a flow diagram depicting an alternate embodiment of the method of replacing an embodiment of a developer roller.

Referring now to FIG. 7, an embodiment of the method of replacing the embodiment of the developer roller 12 shown in FIG. 6 in a printing device 1000 is depicted. The method generally includes moving the drive shaft 24 away from the developer roller 12 and locking the lock mechanism 70, as shown at reference numeral 72; moving the developer roller 12 out of engagement with the spindle assembly 48, as shown at reference numeral 74; removing the developer roller 12 from the apparatus 10, as shown at reference numeral 76; and replacing the removed developer roller 12 with a new developer roller 12 by reversing the process, as shown at reference numeral 78.

More specifically, the method includes axially moving the frusto-conical drive member 28 with the drive shaft 24 from its engagement with one of the opposed ends 14, 16 of the developer roller 12, such that it is disengaged therefrom. In this embodiment of the method, the movement of the drive member 28 and drive shaft 24 to the disengagement position may be accomplished by urging/pulling (which may be accomplished manually) the drive shaft 24 and drive member 28 out of the respective opposed end 14, 16 of the developer roller 12. The drive shaft 24 may then be locked in the disengagement position via the locking mechanism 70.

When the drive shaft 24 is locked in the disengagement position, the other of the opposed ends 16,14 of the developer roller 12 may be removed such that it is no longer engaging the frusto-conical alignment member 56 of the spindle assembly 48. The developer roller 12 may then be removed from the printing device 1000.

Once the developer roller 12 is removed from the printing device 1000, one of the opposed ends 16, 14 of a new developer roller 12 may be engaged with the frusto-conical alignment member 56. The drive shaft 24 may then be unlocked and the drive member 28 moved axially from the disengagement position such that the other of the opposed ends 14, 16 of the new developer roller 12 is engaged therewith. Axially moving the drive shaft 24 to the engagement position may be accomplished by unlocking the lock mechanism 70 and allowing the spring 38 to urge the drive member 28 into the respective one of the opposed ends 14, 16 of the new developer roller 12.

Embodiment(s) of the present disclosure may advantageously be used in a printing device 1000 in order to extend the life of the BID 100 within that printing device 1000.

While several embodiments have been described in detail, it will be apparent to those skilled in the art that the disclosed embodiments may be modified. Therefore, the foregoing description is to be considered exemplary rather than limiting.

What is claimed is:

1. A replaceable developer roller apparatus for a printing device, the apparatus comprising:

a cylindrical developer roller having two opposed ends;

a drive assembly selectively and operatively engageable with one of the opposed ends of the developer roller, the drive assembly including:

a shaft having two opposed regions;

a gear rotationally fixed to one of the opposed regions of the shaft; and a drive member rotationally fixed to the other of the opposed regions of the shaft, and selectively, axially moveable between an engagement position and a disengagement position; and a spindle assembly engageable with the other of the opposed ends of the developer roller, the spindle assembly including:

a spindle assembly shaft; and an alignment member rotationally fixed to the spindle assembly shaft.

2. The apparatus as defined in claim 1 wherein the cylindrical developer roller comprises a hollow conductive material core having an inner tapered wall section at each of the two opposed ends.

3. The apparatus as defined in claim 2 wherein the conductive material core comprises at least one of metals, plastics with conductive material established thereon, and combinations thereof.

4. The apparatus as defined in claim 2 wherein each of the inner tapered wall sections has a taper angle ranging from about 3 degrees to about 7 degrees.

5. The apparatus as defined in claim 2 wherein the developer roller further comprises a conductive polymeric layer established on the hollow conductive material core.

6. The apparatus as defined in claim 2 wherein the drive member is complementarily shaped with the inner tapered wall section of the one of the opposed ends and frictionally engages therewith in the engagement position, and wherein the alignment member is complementarily shaped with the inner tapered wall section of the other of the opposed ends and frictionally engages therewith when the drive member is in the engagement position.

7. The apparatus as defined in claim 1 wherein the drive member is biased toward the engagement position.

8. The apparatus as defined in claim 7 wherein a spring, operatively disposed between the gear and the drive member on the shaft, biases the drive member toward the engagement position.

9. The apparatus as defined in claim 1 wherein the drive member is axially translatable on the shaft between the engagement position and the disengagement position.

10. The apparatus as defined in claim 9 wherein the gear has two opposed faces, and wherein the drive assembly further comprises:

a spring disposed between one of the opposed faces of the gear and the drive member on the shaft, the spring biasing the drive member toward the engagement position;

a first bearing disposed between the spring and the one of the opposed faces of the gear;

a second bearing disposed on the shaft and adjacent the other of the opposed faces of the gear; and at least one drive member retaining clip matingly engaged within an annular notch defined in the other of the opposed regions of the shaft, the at least one clip at a position adapted to prevent the drive member from axially disengaging from the shaft.

11. The apparatus as defined in claim 10, further comprising a washer disposed between the spring and the first bearing.

12. The apparatus as defined in claim 10 wherein the first and second bearings are each roller bearings, sleeve bearings, needle bearings, ball bearings, journal bearings, or combinations thereof.

13. The apparatus as defined in claim 9 wherein the spindle assembly shaft has two opposed regions, wherein the alignment member is rotationally fixed to the spindle assembly shaft at one of the opposed regions, and wherein the spindle assembly further comprises a bearing disposed on the spindle assembly shaft between the alignment member and the other of the opposed regions.

14. The apparatus as defined in claim 9 wherein the other of the opposed regions of the shaft is splined, wherein a center bore of the drive member is splined complementarily to the splined shaft, and wherein the splined shaft drivingly engages with the drive member.

15. The apparatus as defined in claim 1 wherein the drive member is both rotationally and axially fixed to the shaft, and wherein the shaft is axially translatable between the engagement position and the disengagement position.

16. The apparatus as defined in claim 15 wherein the gear has two opposed faces, and wherein the drive assembly further comprises:

a spring disposed between one of the opposed faces of the gear and the drive member on the shaft, the spring biasing the drive member toward the engagement position;

a bearing housing having a first bearing therein and disposed between the one of the opposed faces of the gear and the drive member, the bearing housing adapted to recess a washer therein, and adapted to recess at least a portion of the spring therein;

a second bearing disposed on the shaft between the spring and the drive member; and a selectively engageable locking mechanism adapted to axially lock the shaft in the disengagement position.

17. The apparatus as defined in claim 16, further comprising a washer disposed between the spring and the first bearing.

18. The apparatus as defined in claim 16 wherein the first bearing is one of a roller bearing, a journal bearing, and a needle bearing, and wherein the second bearing is one of a needle bearing and a journal bearing.

19. The apparatus as defined in claim 15 wherein the spindle assembly shaft has two opposed regions, wherein the alignment member is rotationally fixed to the spindle assembly shaft at one of the opposed regions, and wherein the spindle assembly further comprises:

a bearing disposed on the spindle assembly shaft between the alignment member and the other of the opposed regions; and a washer disposed on the spindle assembly shaft between the bearing and the other of the opposed regions.

20. The apparatus as defined in claim 15 wherein the gear is rotationally fixed to the shaft.

21. The apparatus as defined in claim 1 wherein at least a portion of at least one member selected from the drive member and the alignment member has a frusto-conical shape.

22. A method of replacing a developer roller in a printing device, the method comprising:

axially moving a drive member from engagement with one of two opposed ends of a cylindrical developer roller to disengage therefrom, the drive member being part of a drive assembly including a shaft having two opposed regions; a gear rotationally fixed to one of the opposed regions of the shaft; and the drive member rotationally fixed to the other of the opposed regions of the shaft;

removing the other of the opposed ends of the developer roller from engagement with an alignment member, the alignment member being part of a spindle assembly including a spindle assembly shaft and the alignment member being rotationally fixed to the spindle assembly shaft;

engaging an other of two opposed ends of a new developer roller with the alignment member; and axially moving the drive member from disengagement with one of the opposed ends of the new developer roller to engagement therewith.

23. The method as defined in claim 22 wherein the drive member moves axially either independently of the shaft or with the shaft.

24. The method as defined in claim 23 wherein the drive member moves axially independently of the shaft, and wherein the axially moving to disengagement is accomplished by urging the drive member out of the one of the opposed ends of the developer roller and toward the gear.

25. The method as defined in claim 24 wherein the urging is accomplished by a tool.

26. The method as defined in claim 24 wherein the gear has two opposed faces, wherein the drive assembly further comprises:

a spring disposed between one of the opposed faces of the gear and the drive member on the shaft, the spring biasing the drive member toward the engagement position;

a first bearing disposed between the spring and the one of the opposed faces of the gear;

a second bearing disposed on the shaft and adjacent the other of the opposed faces of the gear; and at least one drive member retaining clip matingly engaged within an annular notch defined in the other of the opposed regions of the shaft, the at least one clip at a position adapted to prevent the drive member from axially disengaging from the shaft;

and wherein the axially moving to engagement is accomplished by allowing the spring to urge the drive member into the one of the opposed ends of the developer roller.

27. The method as defined in claim 23 wherein the drive member moves axially with the shaft, and wherein the axially moving to disengagement is accomplished by urging the drive member out of the one of the opposed ends of the developer roller and then locking the shaft in the disengagement position.

28. The method as defined in claim 27 wherein the urging is accomplished manually.

29. The method as defined in claim 27 wherein the gear has two opposed faces, and wherein the drive assembly further comprises:

a spring disposed between one of the opposed faces of the gear and the drive member on the shaft, the spring biasing the drive member toward the engagement position;

a bearing housing having a first bearing therein and disposed between the one of the opposed faces of the gear and the drive member, the bearing housing adapted to recess at least a portion of the spring therein;

a second bearing disposed on the shaft between the spring and the drive member; and a selectively engageable locking mechanism adapted to axially lock the shaft in the disengagement position;

and wherein the axially moving to engagement is accomplished by unlocking the shaft and allowing the spring to urge the drive member into the one of the opposed ends of the developer roller.

30. The method as defined in claim 22 wherein at least a portion of at least one member selected from the drive member and the alignment member has a frusto-conical shape.

31. A method for removing a developer roller from a printing device, the method comprising:

axially moving a frusto-conical drive member from engagement with one of two opposed ends of a hollow cylindrical developer roller to disengage therefrom, the frusto-conical member being part of a drive assembly including a shaft having two opposed regions; a gear rotationally fixed to one of the opposed regions of the shaft; and the frusto-conical drive member rotationally fixed to the other of the opposed regions of the shaft;

removing the other of the opposed ends of the developer roller from engagement with a frusto-conical alignment member, the alignment member being part of a spindle assembly including a spindle assembly shaft and the frusto-conical alignment member rotationally fixed to the spindle assembly shaft; and removing the developer roller from the printing device.

32. A printing device, comprising:

a replaceable developer roller apparatus, including:

a cylindrical developer roller having two opposed ends;

a drive assembly selectively and operatively engageable with one of the opposed ends of the developer roller, the drive assembly including:

a shaft having two opposed regions;

a gear rotationally fixed to one of the opposed regions of the shaft; and a frusto-conical drive member rotationally fixed to the other of the opposed regions of the shaft, and selectively, axially moveable between an engagement position and a disengagement position; and a spindle assembly engageable with the other of the opposed ends of the developer roller, the spindle assembly including:

a spindle assembly shaft; and a frusto-conical alignment member rotationally fixed to the spindle assembly shaft.

33. The printing device as defined in claim 32 wherein the printing device is a liquid electro photography (LEP) printer.

34. A developer roller for use in a printing device, the roller comprising:

a hollow, cylindrical core having two opposed ends; and an inner, tapered wall section defined at each of the opposed ends of the core, wherein one of the opposed end tapered wall sections is adapted to frictionally engage a complementarily shaped frusto-conical drive member, and wherein the other of the opposed end tapered wall sections is adapted to frictionally engage a complementarily shaped frusto-conical alignment member;

wherein the frusto-conical drive member is part of a drive assembly, including:

a shaft having two opposed regions;

a gear rotationally fixed to one of the opposed regions of the shaft, the frusto-conical drive member being rotationally fixed to the other of the opposed regions of the shaft, and selectively, axially moveable between an engagement position and a disengagement position.

35. The developer roller as defined in claim 34 wherein the frusto-conical alignment member is part of a spindle assembly, including a spindle assembly shaft, wherein the frusto-conical alignment member is rotationally fixed to the spindle assembly shaft.

* * * * *